US010247057B2

(12) United States Patent
Boese

(10) Patent No.: US 10,247,057 B2
(45) Date of Patent: Apr. 2, 2019

(54) CAMSHAFT ADJUSTER HAVING A VARIABLE-LENGTH INSERT PART

(71) Applicant: Schaeffler Technologies AG & Co. KG, Herzogenaurach (DE)

(72) Inventor: Olaf Boese, Nuremberg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 47 days.

(21) Appl. No.: 15/309,429

(22) PCT Filed: Jan. 22, 2015

(86) PCT No.: PCT/DE2015/200018

§ 371 (c)(1),
(2) Date: Nov. 7, 2016

(87) PCT Pub. No.: WO2015/169294

PCT Pub. Date: Nov. 12, 2015

(65) Prior Publication Data

US 2017/0152767 A1 Jun. 1, 2017

(30) Foreign Application Priority Data

May 8, 2014 (DE) ..... 10 2014 208 601

(51) Int. Cl.
*F01L 1/344* (2006.01)
*F01L 1/46* (2006.01)
*F01L 1/02* (2006.01)

(52) U.S. Cl.
CPC ..... *F01L 1/3442* (2013.01); *F01L 1/022* (2013.01); *F01L 1/46* (2013.01);
(Continued)

(58) Field of Classification Search
CPC ... F01L 2001/34453; F01L 2001/34463; F01L 2001/34466; F01L 2001/34469; F01L 2001/34476; F01L 1/46
(Continued)

(56) References Cited

U.S. PATENT DOCUMENTS 7,578,274 B2 * 8/2009 Kleiber ..... F01L 1/3442 123/90.15
8,881,700 B2 11/2014 Brenner et al.
(Continued)

FOREIGN PATENT DOCUMENTS

CN 103016090 4/2013
CN 103210186 7/2013
(Continued)

*Primary Examiner* — Jorge Leon, Jr.
(74) *Attorney, Agent, or Firm* — Davidson, Davidson & Kappel, LLC

(57) ABSTRACT

A vane-type, hydraulic cam shaft adjuster (1, 20) having a stator (2) and a rotor that is rotatably mounted in relation to the stator (2), wherein at least one locking bolt (10) is provided in order to limit the rotor in relation to the stator (2), in at least one direction of rotation, when the locking bolt is brought into contact with a slot guide (12) of an insert part (4, 21), wherein the insert part (4, 21) is secured in a component (2) that is secured to the stator, wherein the insert part has securing regions, between which securing regions and the component (2) that is secured to the stator there is frictional connection, and wherein the insert part (4, 21) is formed, in terms of material and geometrics, in such a way that a deformation (19) causes a change in length (18) of the insert part (4, 21), involving the friction connection.

9 Claims, 5 Drawing Sheets

(52) U.S. Cl.
CPC ..... *F01L 2001/34453* (2013.01); *F01L 2001/34463* (2013.01); *F01L 2001/34466* (2013.01); *F01L 2001/34469* (2013.01); *F01L 2001/34476* (2013.01)

(58) Field of Classification Search
USPC ..... 123/90.17
See application file for complete search history.

(56) References Cited

U.S. PATENT DOCUMENTS

| | | | | |
|---|---|---|---|---|
| 2001/0054405 | A1 | 12/2001 | Miyasaka | |
| 2002/0139332 | A1 | 10/2002 | Takenaka | |
| 2003/0062011 | A1 | 4/2003 | Hori | |
| 2003/0217716 | A1 | 11/2003 | Kusano et al. | |
| 2012/0279466 | A1* | 11/2012 | Schober | F01L 1/352 123/90.17 |
| 2013/0199479 | A1 | 8/2013 | Ottersbach et al. | |
| 2013/0220252 | A1* | 8/2013 | Brenner | F01L 1/3442 123/90.17 |
| 2013/0233263 | A1 | 9/2013 | Kinouchi | |
| 2013/0284132 | A1* | 10/2013 | Watanabe | F01L 1/34 123/90.15 |
| 2014/0102388 | A1* | 4/2014 | Kato | F01L 1/3442 123/90.15 |

FOREIGN PATENT DOCUMENTS

| | | | | |
|---|---|---|---|---|
| DE | 102007019920 | A1 * | 11/2008 | F01L 1/3442 |
| DE | 102007019920 | A1 | 11/2008 | |
| DE | 102012203114 | A1 | 8/2013 | |

* cited by examiner

CAMSHAFT ADJUSTER HAVING A VARIABLE-LENGTH INSERT PART

The present invention relates to a hydraulic camshaft adjuster of the vane cell type including a stator and a rotor, the rotor being mounted rotatably relative to the stator, and at least one locking bolt being provided to limit the rotor in relation to the stator at least in one rotating direction when the locking bolt makes contact with a gate of an insert part, the insert part being attached in a component fixed to the stator, such as the stator, a sprocket or a cover, the insert part including attachment areas between which and the component fixed to the stator a force fit prevails or is present.

BACKGROUND

A camshaft adjuster of the type mentioned at the outset is known from DE 10 2012 203 114 A1, for example. This unexamined patent application describes a camshaft adjusting device for an internal combustion engine of a motor vehicle, including a drive part, such as an outer rotor, and an output part, such as an inner rotor, the output part being mounted rotatably relative to the drive part between a first angular position and a second angular position, furthermore an insert part, which originally is separate from the drive part and the output part, being situated in a rotation angle limiting gate formed in the drive part or the output part, the insert part being situated so as to make blocking contact with two axially movable blocking elements, such as pins or journals. This unexamined patent application furthermore also describes a timing drive including such a camshaft adjusting device, and an internal combustion engine including such a timing drive.

Gas exchange valves of internal combustion engines may be actuated by lobes of a camshaft. The opening and closing times of the gas exchange valves may be deliberately established via the arrangement and shape of the lobes. The camshaft is usually actuated, driven and/or controlled by the crankshaft of the internal combustion engine. The opening and closing points in time of the gas exchange valves of the internal combustion engine are usually predefined by a relative rotational position or phase position or angular position between the lobes and the crankshaft. A variable adjustment of the opening and closing points in time of the gas exchange valves may be achieved by a relative change of this relative rotational position between the camshaft and the crankshaft. With the aid of the variable adjustment of the opening and closing points in time of the gas exchange valves, it is possible, as a function of the instantaneous operating state of the internal combustion engine, to positively influence the emission characteristics, for example, to lower the fuel consumption, to increase the efficiency and/or to increase the maximum torque and/or the maximum power of the internal combustion engine.

This variable adjustment of the opening and closing points in time of the gas exchange valves may be carried out or made possible by a camshaft adjusting device, or such a camshaft adjuster, provided between the crankshaft and the camshaft.

For this purpose, conventionally a camshaft adjuster is provided in the kinematic chain between the crankshaft and the camshaft. One part of the camshaft adjuster, which hereafter is referred to as the stator, is connected preferably non-rotatably to the crankshaft. Another part of the camshaft adjuster, which hereafter is referred to as the rotor, is connected preferably non-rotatably to the camshaft. Conventionally, a gear is provided between the stator and the rotor. In a hydraulic camshaft adjuster of the vane cell type, this gear is usually provided in the form of a hydraulically actuated vane cell, or a plurality thereof. By applying hydraulic pressure to the vane cell, it is possible, for example with the aid of a control unit and/or valves, to achieve the variable adjustment of the opening and closing points in time of the gas exchange valves. This embodiment may also be referred to as a rotary piston adjuster.

It is possible for operating states to occur in a hydraulic camshaft adjuster during which this hydraulic actuation or hydraulic control is not possible or not ensured or not economical or not desirable. For example, the rotational position is usually not hydraulically predefined during a starting process of the internal combustion engine. An uncontrolled rotational position or an uncontrolled change of the rotational position may cause, for example, increased wear of the camshaft adjuster, of the camshaft, of the gas exchange valves, or in general of the internal combustion engine. To avoid the uncontrolled rotational position or the uncontrolled change of the rotational position, a releasable or liftable locking of the rotor to the stator is desired. Based on the rotational position of the gas exchange valves, "early" locking, "intermediate" locking or "late" locking may be desired. These are referred to as advance position, intermediate position, retard position, advance locking, intermediate locking, retard locking or the like.

For this purpose, it is known from the prior art mentioned at the outset to provide a blocking element, such as a bolt, a peg or a pin. The blocking element may be accommodated or mounted or attached in the rotor, for example. The blocking element may be actuated by a spring preload, for example. The blocking element may be hydraulically released or lifted, for example. The blocking element may make contact with a locking gate of the stator, for example. For example, the locking gate may be provided in one piece in the stator, or may, for example, be designed as an insert part. When differing requirements exist with regard to the gate and the part accommodating the gate, for example with respect to the hardness, it is advantageous if the locking gate is formed by an insert part.

Such insert parts may be inserted during assembly, for example when a clearance fit is present, or may be pressed in, for example when an interference fit is present. Insertion with a clearance fit offers the advantage that the assembly is easy to be carried out. A clearance fit, however, has the disadvantage during operation that noise development and/or clearance-induced wear may occur. An interference fit has the disadvantage during assembly that mechanical overdeterminations, for example due to complex component geometries, are not economically preventable. An interference fit, however, has the advantage during operation that noise development and/or clearance-induced wear may be prevented.

SUMMARY OF THE INVENTION

It is an object of the present invention to provide a hydraulic camshaft adjuster of the vane cell type, in which the above-described disadvantages do not occur or in which the above-described advantages are achievable. In particular, it is an object of the present invention to provide a hydraulic camshaft adjuster of the vane cell type including an insert part, in which a clearance fit during assembly is combinable with a force fit during operation. In particular, it is the object of the present invention to provide such a camshaft adjuster including an insert part and having a particular suitability for a central locking mechanism.

The present invention provides that the insert part in a generic camshaft adjuster is designed in such a way in terms of the material and geometry that an (at least) elastic and/or plastic deformation brings about or induces an elongation of the insert part which results in the force fit. An (at least) elastic deformation has the advantage that in this way the pretension required for an interference fit may be achieved. An elongation of the insert part has the advantage that in this way a clearance fit during assembly and an interference fit during operation may be achieved. The presence of a force fit has the advantage that an interference fit is thus achievable.

It shall be mentioned at this point that it is secondary for the function of the present invention whether the locking bolt is provided on the rotor and the gate is provided on the stator, or whether the locking bolt is provided on the stator and the gate on the rotor. In this respect, the terms "stator" and "rotor" may be reversed in the claims, for example for installation space considerations, i.e., a kinematic reversal may also be covered.

The insert part may include a deformation area including at least two members between the attachment areas, each of the members connecting the attachment areas to one another, and the sections of the insert part being matched to one another in such a way that an at least elastic deformation of the members toward one another or away from one another brings about or induces the change in length of the insert part. The members may be integral sections of the insert part or of a main component of the insert part or be components which are separate in terms of the material, but connected to the insert part in a force-fit and/or form-locked manner. By providing the insert part as a separate component including attachment areas and a deformation area, it is possible to provide a gate area of the insert part in a hardened manner and to provide the deformation area in an elastic manner. In this way, it is possible, by influencing the material properties, to select/predetermine material properties for easy deformability and material properties for reduced wear in a (single) component.

It is advantageous if the insert part and the component fixed to the stator are designed or configured or dimensioned in such a way or in such a cooperating manner that the insert part is insertable with play into the component fixed to the stator as a result of the change in length. This may be achieved in that an effective direction of the attachment areas effectuating the attachment acts approximately in the direction of the change in length of the insert part. In other words, this may be achieved in that the attachment areas approximately project from the direction of the change in length or are situated laterally offset from a straight longitudinal axis. In particular, it may be provided that the attachment areas project from the direction of the change in length, together causing the attachment.

Furthermore, two locking bolts may be provided to limit a rotational movement of the rotor in relation to the stator when the locking bolt makes contact with a respective gate of the insert part. By providing two locking bolts, it is possible, using a simple design, to limit a respective rotational movement in the opposite direction.

In particular, it may be provided that a rotation of the rotor in relation to the stator may be limited in the central locking position or to achieve a central locking position. In this way, the advantages of a central locking mechanism may be achieved, such as a relatively likely occurring engagement of the locking bolts in the locking gate.

If the insert part, for assembly, is grasped/seized/gripped using a gripping motion which applies a force on the insert part, it is advantageous if this gripping motion effectuates/brings about the elastic deformation of the insert part. In this way, the number of the necessary assembly steps may be reduced. In this respect, it may be provided that the insert part is designed and configured in such a way that the at least elastic deformation of the insert part impacts the insert part prior to the insertion and is at least partially cancelled after the insertion. In other words, it may be provided that an at least elastic deformation is present on the insert part prior to the insertion and is at least partially cancelled after the insertion.

Depending on the design of the insert part or depending on the complexity of the insertion process, it may be useful, for example for economical reasons, to chronologically and/or functionally separate the deformation and the gripping of the insert part. In this respect, it may be provided that the insert part is designed in such a way in terms of the material and geometry that the deformation is exerted on the inserted insert part or the deformation affects the inserted insert part. According to one refinement thereof, a plastic deformation of the insert part may be provided or made possible, whereby particularly large tolerances are made possible in an economical manner. In other words, it may be provided that the deformation is present on the insert part after the insertion. In still other words, it may be provided that the insert part and the component fixed to the stator are designed in such a way in terms of the material and geometry that the deformation may be applied to the insert part after the insert part has been inserted.

To separate the deformation, using a simple design, during assembly chronologically and/or in the sequence of the assembly steps, a deformation part deforming the inserted insert part may be provided. In other words, it may be provided that first the insert part is inserted before a deformation part is introduced. By providing the deformation part, it is furthermore possible to bring about a plastic deformation of the insert part. A plastic deformation means (with otherwise identical parameters) a deformation by a greater magnitude than with a purely elastic deformation, which is why rougher tolerances and thus a more cost-effective production are possible.

From economical aspects, for example, different deformation parts may be useful. By way of example, a pin, a bolt, a screw, a cone, a wedge, a cone-head screw, or a cylindrical, chamfered component are provided here. It may be economical and/or be useful for weight reasons and/or for deformation reasons if the deformation part is composed of solid material or formed by a hollow component. In particular, it may be provided that the insert part and/or the deformation part are/is selected to fit one another in terms of the material and/or geometry and the desired degree of deformation.

For the purpose of a settability of the deformation, it may be provided that the deformation part has a lobe-like and/or eccentric outer contour in such a way that the deformation part may be introduced with play, and the deformation may be caused by a rotation of the deformation part.

The camshaft adjuster may be designed in such a way that locking forces, which act between the locking bolt and the gate, for example, intensify the force fit. In this way, it may advantageously be ensured that the force fit is also maintained during operation.

The present invention furthermore relates to a timing drive including a camshaft adjuster as described above.

The present invention moreover relates to an internal combustion engine including a timing drive as described above.

In other words, the object is achieved according to the present invention as described hereafter. The insert part is designed in such a way that an (at least) elastic deformation is possible. By application of a force during assembly, the insert part is deformed in such a way that this may be inserted into a component accommodating the insert part, such as the stator, a component fixed to the stator, a cover, or a sprocket. ("Accommodating" in this case may be understood to mean merely a force-fit contact, and not necessarily a complete geometrical accommodation of one body in another body.)

Thereafter, the component springs back or the elastic deformation relaxes, and the insert part is thus braced in the component accommodating the insert part. The component accommodating the insert part may also be referred to as a mating gate. In this way, the insert part is attached to the component accommodating the insert part during subsequent handling, or it is possible to prevent the component from falling out of the component accommodating the insert part. An assembly direction of the component accommodating the insert part may thus be provided independently of the insert part.

One further variant may provide that the insert part is elastically or elastically-plastically deformed by the introduction of an additional component, in order to brace the insert part in the component accommodating the insert part. This additional component may remain in the component accommodating the insert part, together with the insert part. In this way, a deformable insert part is provided. The insert part may be braced in the component accommodating the insert part as a result of this deformation.

The deformation may in particular take place so far until the insert part, when relaxing or springing back, braces in the component accommodating the insert part. Alternatively or cumulatively, an additional component may generate the deformation. The additional component may be a pin or a wedge, for example. The additional component may remain in the component accommodating the insert part, together with the insert part.

BRIEF DESCRIPTION OF THE DRAWINGS

The present invention is described hereafter in greater detail with the aid of two exemplary embodiments.

DETAILED DESCRIPTION

Figure 1:
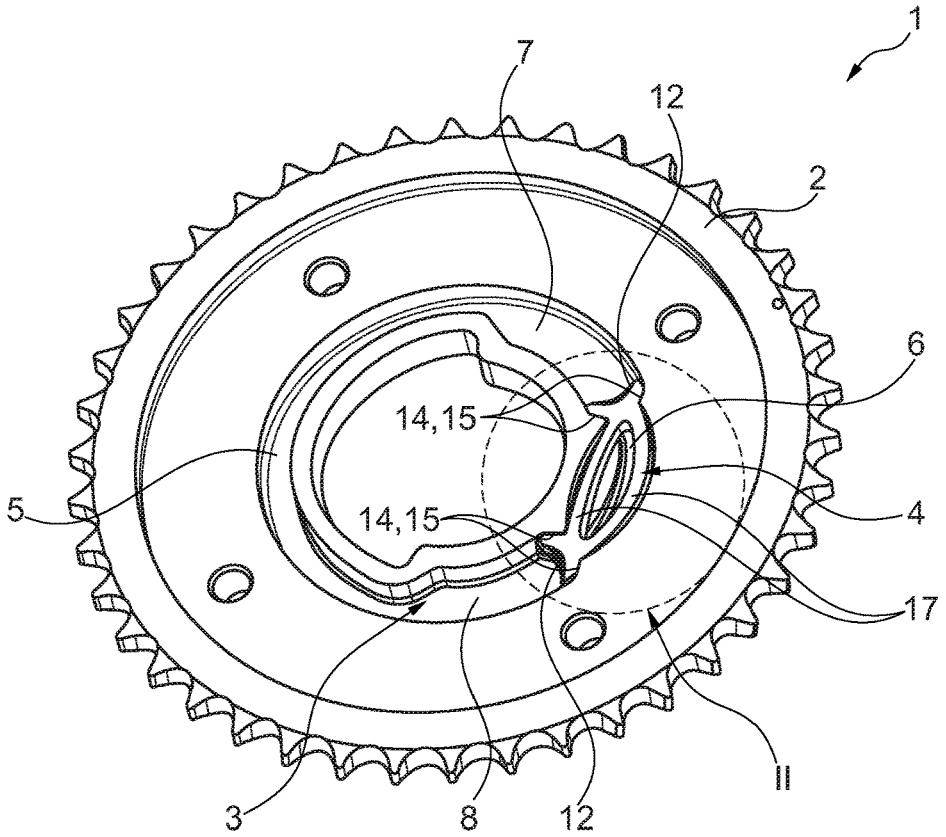
FIG. 1 shows a perspective view of a sprocket including an inserted insert part according to the first specific embodiment of the present invention.
Figure 2:
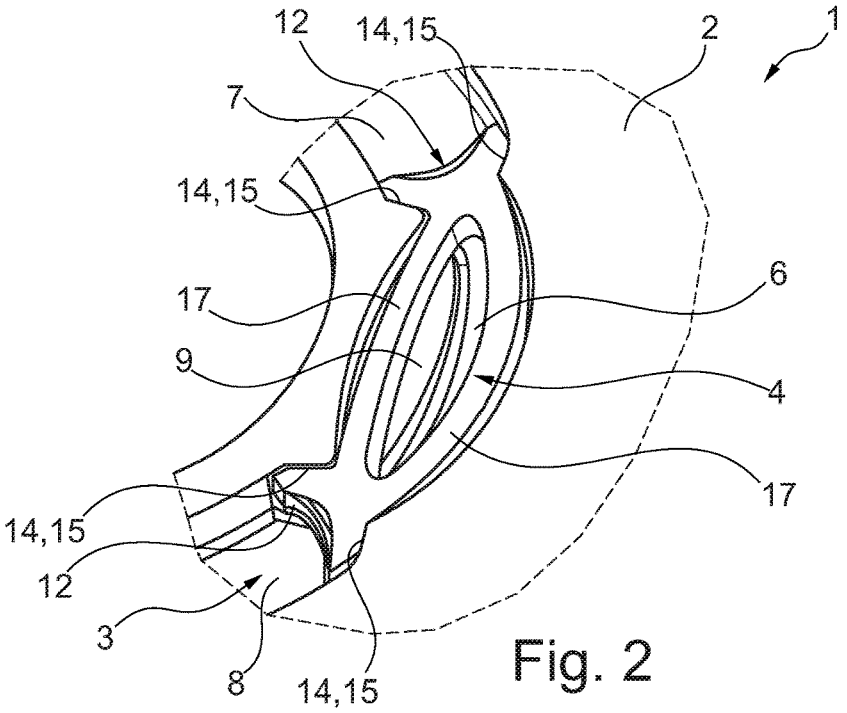
FIG. 2 shows an enlarged view of the area of FIG. 1 denoted by II.
Figure 3:
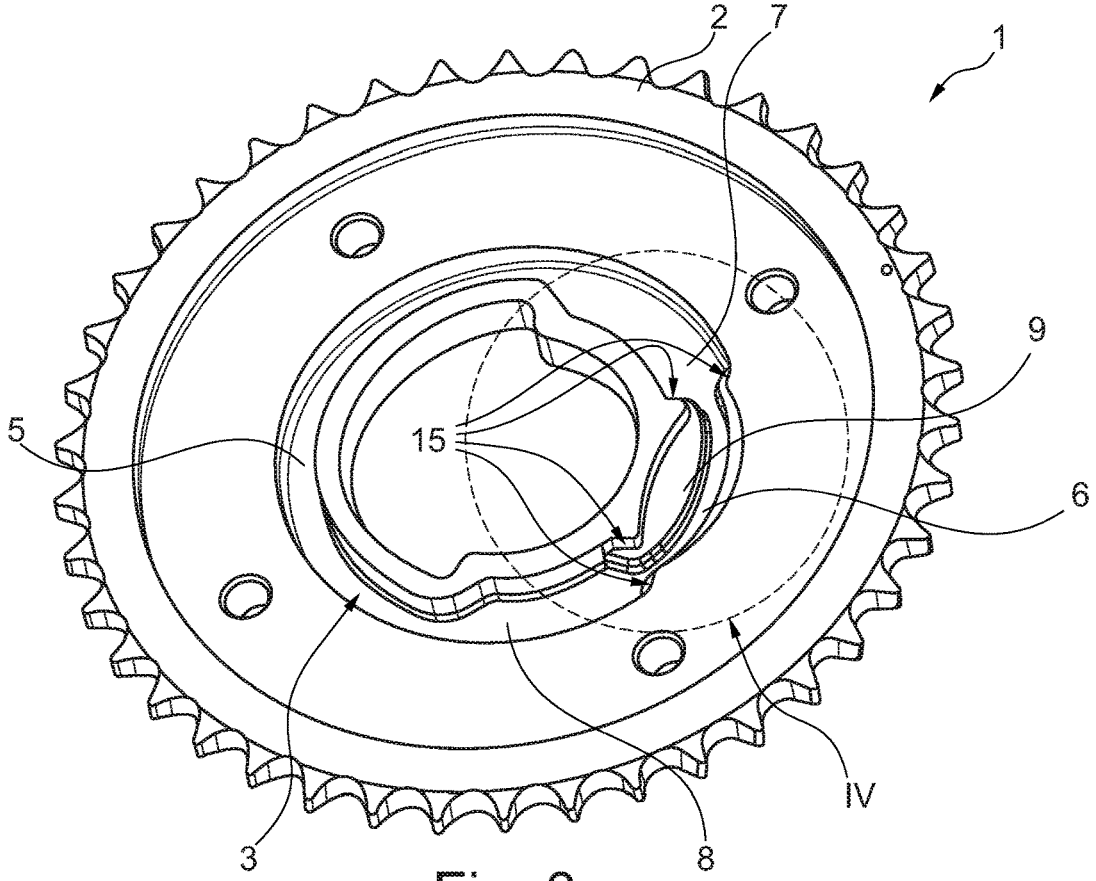
FIG. 3 shows a perspective view of a sprocket according to the first specific embodiment.
Figure 4:
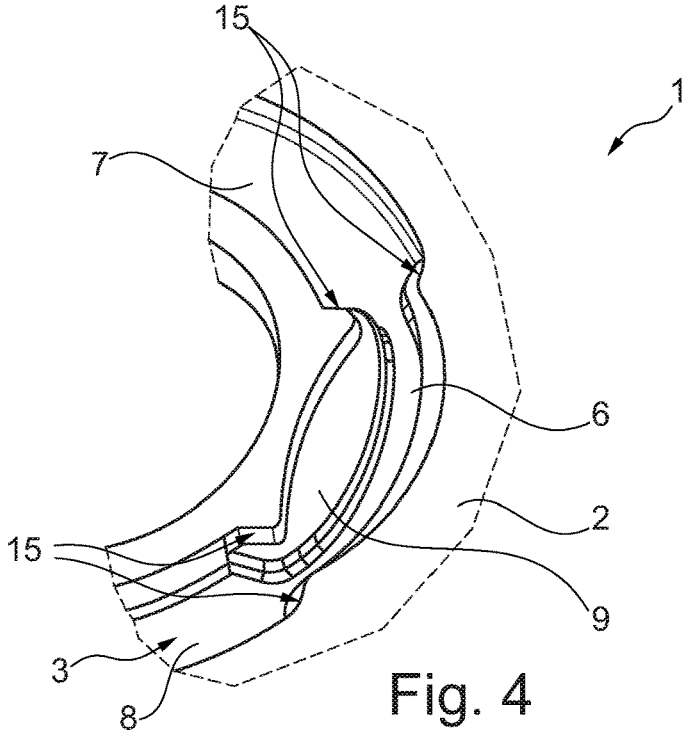
FIG. 4 shows an enlarged view of the area of FIG. 3 denoted by IV.

The figures are only of a schematic nature and provide only a better understanding of the present invention. Identical elements are denoted by the same reference numerals. Elements of the individual exemplary embodiments may be exchanged among one another.

Hereafter, a first specific embodiment of the present invention is described with reference to FIG. 1 through FIG. 8. A hydraulic camshaft adjuster 1 including a stator 2 is shown. A rotor is provided, but not shown. Stator 2 is formed by a sprocket wheel. An insert part 4 is provided in a recess 3 of stator 2. Insert part 4 according to the first specific embodiment is shown in FIGS. 1 through 2 and 5 through 8.

Recess 3, which is provided in the form of an annular closed groove, for example, is provided with hydraulic groove sections 5 and 6, locking bolt engagement sections 7 and 8, and an insert section 9.

The first specific embodiment shows a camshaft adjuster for central locking. Accordingly, two locking bolts 10 engage in locking bolt engagement sections 7 and 8. Furthermore, two gate areas 11 are accordingly provided on insert part 4. A respective gate 12 is formed in gate areas 11 as a surface section of insert part 4.

Figure 7:
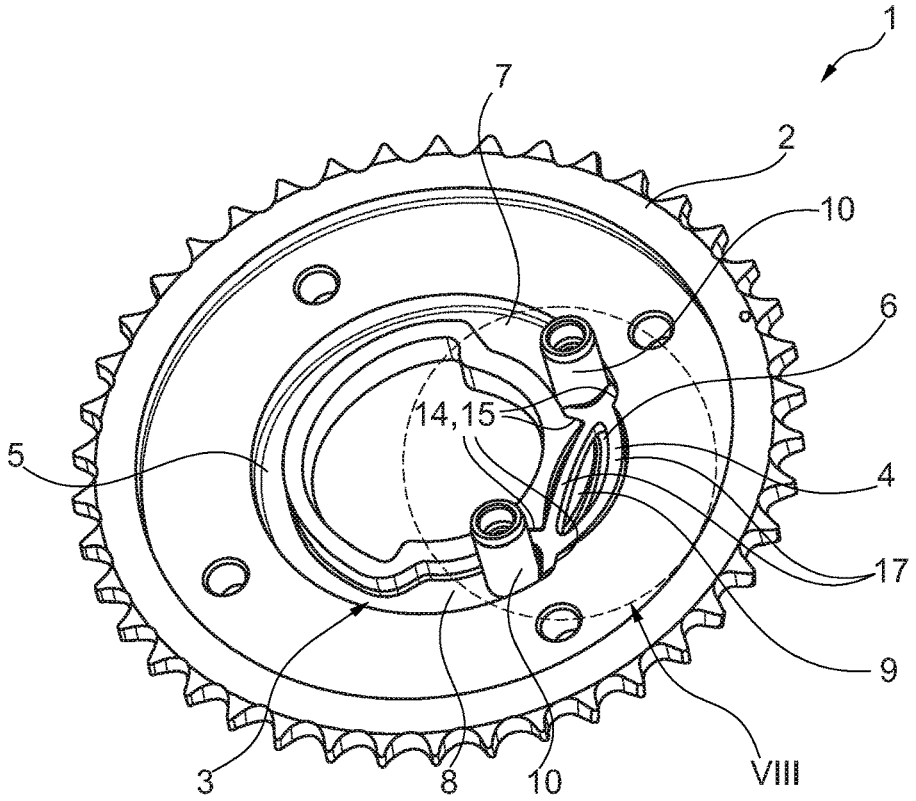
FIG. 7 shows a perspective view of a sprocket including an inserted insert part and including two locking bolts according to the first specific embodiment.
Figure 8:
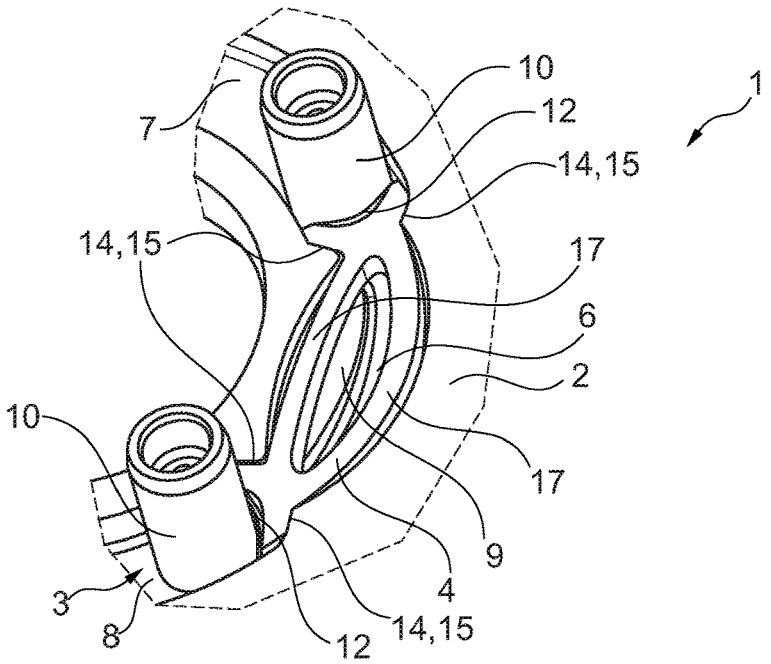
FIG. 8 shows an enlarged view of the area of FIG. 7 denoted by VIII.

In FIG. 7 and FIG. 8, locking bolts 10 may be seen in the locking position, locking bolts 10 via their respective lateral surfaces or outer contours abutting and making contact with gates 12 of insert part 4.

In the figures, recess 3 including sections 5 through 9 is shown open. In the fully assembled camshaft adjuster, however, recess 3 is sealingly closed, and a hydraulic pressure may be applied thereto via a hydraulic medium supply line, which is not shown. Bolts 10 may be pushed out of the locking position by the hydraulic pressure approximately along the bolt center line.

Two attachment areas 13 are furthermore provided on insert part 4. On attachment areas 13, attachment sections 14 are formed as surface sections of insert part 4. Furthermore, attachment sections 15 are provided on sprocket 2 in the transition from locking bolt engagement sections 7 and 8 to insert section 9. Attachment sections 15 are designed in a complementary manner to attachment sections 14. As is apparent from the representation of FIGS. 7 and 8, bolts 10 push attachment areas 13 and attachment sections 14 onto attachment sections 15 of stator 2 with the aid of gates 12 and gate areas 11. Attachment forces occur between attachment sections 14 and 15. A force fit is thus generated in such a way that insert part 4 is attached in recess 3. Locking forces intensify the attachment forces.

A deformation area 16 including two deformation members 17 or including two members 17 of insert part 4 are provided between attachment sections 14 of attachment areas 13. Members 17 extend in an elongation direction 18, members 17 having a convex shape to elongation direction 18. For the sake of clarity, elongation direction 18 is shown only in FIG. 5. When members 17 are now compressed by a force, which is represented by force arrows 19 in FIG. 5, attachment areas 13 are moved in elongation direction 18. In this respect, an elastic deformation of insert part 4 brings about an elongation of insert part 4. If in the geometry of insert part 4 shown in the first specific embodiment the force in the direction of force arrows 19 is cancelled, and insert part 4 is inserted into insert section 9, attachment sections 14 and 15 make contact with one another in a force-fit manner.

In this way, by causing an elastic deformation in the direction of force arrows 19 an elongation of insert part 4 may be brought about, resulting in a force fit.

Figure 9:
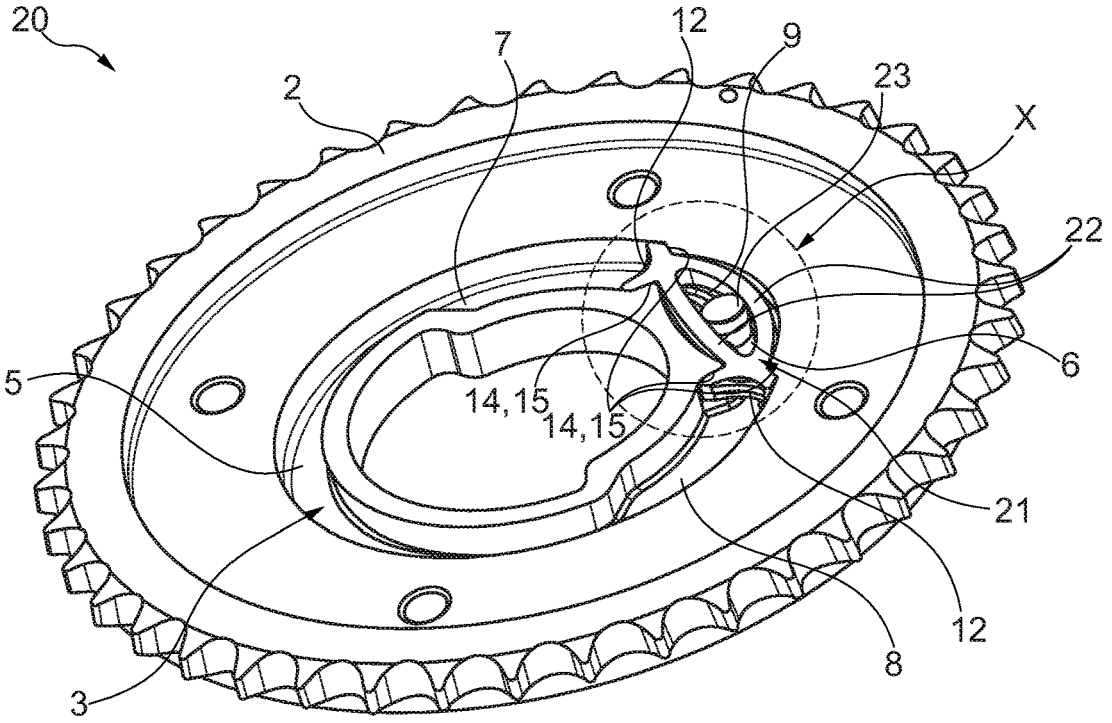
FIG. 9 shows a perspective view of a sprocket including an inserted insert part and including a deformation part according to a second specific embodiment of the present invention.
Figure 10:
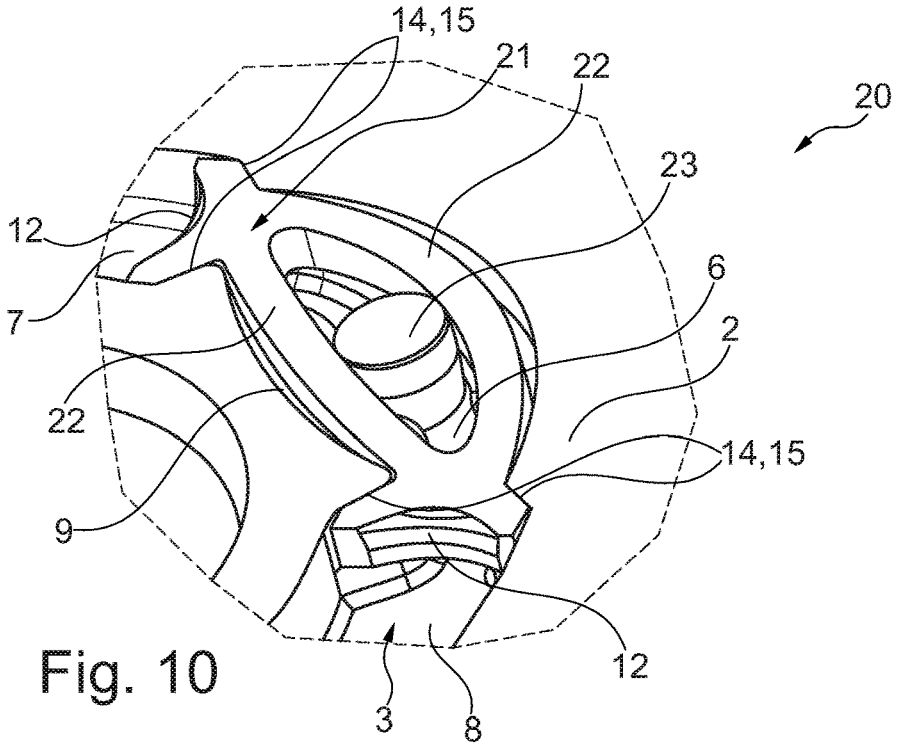
FIG. 10 shows an enlarged view of the area of FIG. 9 denoted by X.

Hereafter, a second specific embodiment of the present invention is addressed based on FIGS. 9 and 10. To avoid redundancies, only differences of the second specific embodiment compared to the first specific embodiment are described as far as possible.

FIGS. 9 and 10 show a camshaft adjuster 20. In camshaft adjuster 20, an insert part 21 has been inserted into stator 2. Insert part 21 includes the two gate areas 11 having one gate 12 each, the two attachment areas 13 having one attachment section 14 each, and the deformation area 16 having two deformation members 22.

During assembly, insert part 21 is inserted into recess 3 of stator 2 without force and/or with play. Then, a deformation part 23 is pressed between the two members 22. Deformation part 23 has the shape of a chamfered bolt here. By pressing deformation part 23 between the two members 22, the two members 22 are pushed apart and elastically-plastically deformed.

The elastic-plastic deformation of insert part 21 generated with the aid of deformation part 23 has a greater magnitude of deformation compared to insert part 4 of the first specific embodiment. In this way, the clearance fit between insert part 21 and recess 3 may be designed to have a lot of play, and insert part 21 may be inserted into stator 2 quickly and with only little precision. Insert part 21 of the second specific embodiment may thus be manufactured with lower tolerance requirements than insert part 4 of the first specific embodiment. Moreover, the work steps "inserting" and "deforming" are chronologically separated from one another. In this way, an insertion tool may be dispensed with, for example.

Figure 5:
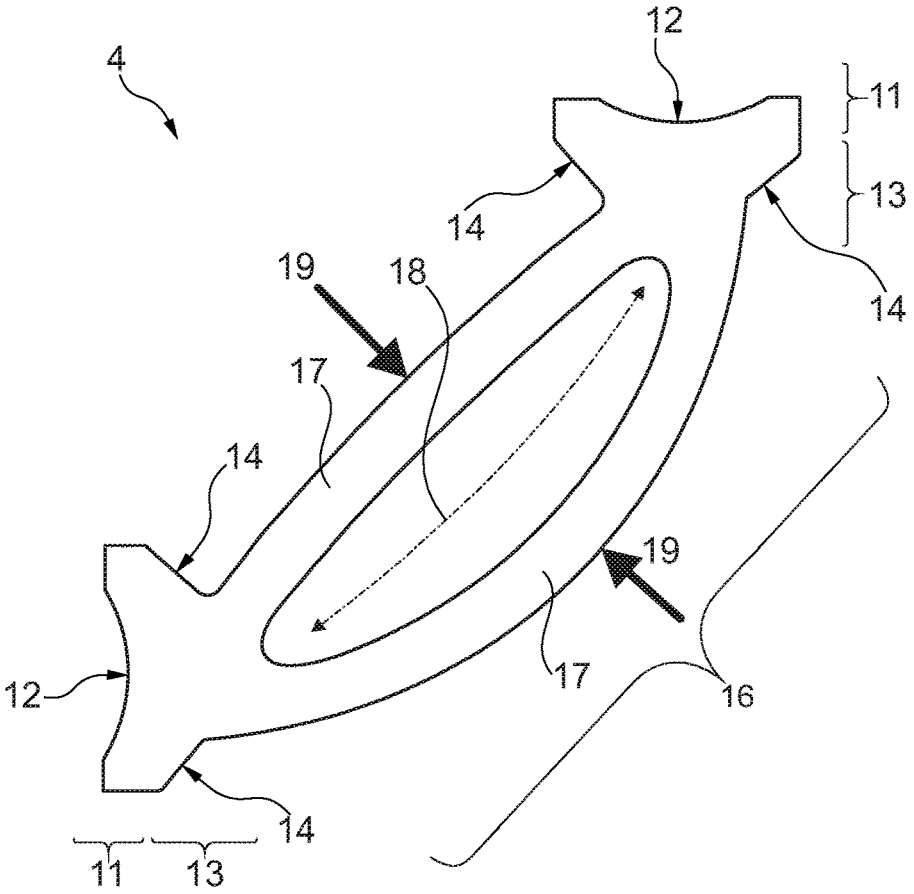
FIG. 5 shows a top view onto an insert part according to the first specific embodiment.
Figure 6:
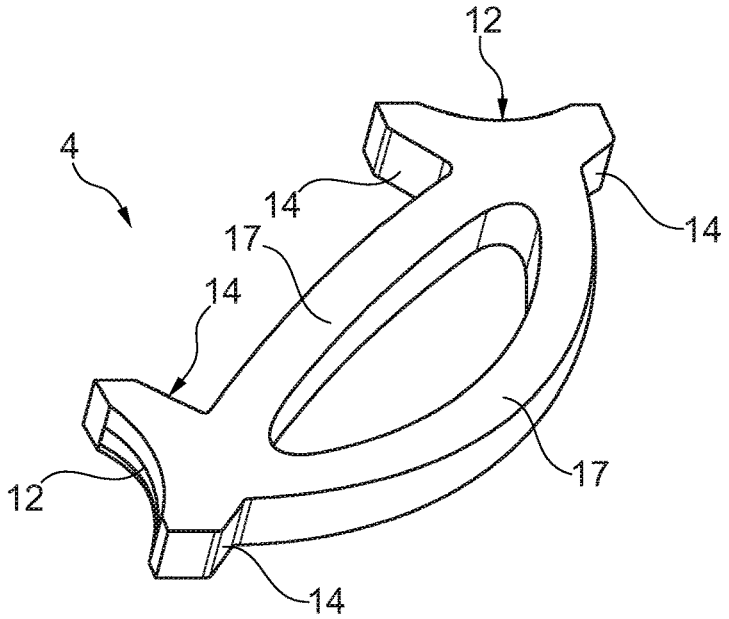
FIG. 6 shows a perspective view of an insert part according to the first specific embodiment.

The deformation of members 22 effectuates/brings about an elongation of insert part 21 that is perpendicular to the elongation 18 of insert part 4 shown in FIG. 5. As a result, attachment areas 13 are pulled toward one another, so that attachment sections 14 of insert part 21 and attachment sections 15 of stator 2 make contact with one another in a force-fit manner. Insert part 21 is thus attached to stator 2 in a force-fit manner. Insert part 21 is no longer able to fall out of stator 2 during the subsequent assembly steps.

In this respect, insert part 21 may be introduced with play into stator 2 of camshaft adjuster 20 in the second specific embodiment, and a force-fit interference fit between insert part 21 and stator 2 is ensured with the aid of deformation part 23.

According to one refinement of the second specific embodiment, which is not shown in the figures, an insert part having a one-member deformation area may be provided. In this case, the deformation part is pressed between a surface of insert section 9 and the deformation area, bringing about the deformation and thus an elongation of the insert part and resulting in a force fit.

LIST OF REFERENCE NUMERALS

1 camshaft adjuster
2 stator
3 recess
4 insert part
5, 6 hydraulic groove sections
7, 8 locking bolt engagement section
9 insert section
10 locking bolt
11 gate area
12 gate
13 attachment area
14, 15 attachment section
16 deformation area
17 member
18 elongation direction
19 force arrow
20 camshaft adjuster
21 insert part
22 member
23 deformation part

What is claimed is:

1. A vane-cell hydraulic camshaft adjuster comprising:

a stator and a rotor, the rotor being mounted rotatably relative to the stator; and at least one locking bolt provided to limit the rotor in relation to the stator at least in one rotating direction when the locking bolt makes contact with a gate of an insert part, the insert part being attached in a component fixed to the stator, the insert part including attachment areas via which a force fit with the component fixed to the stator prevails, the insert part being designed in such a way in terms of material and geometry that a deformation brings about an elongation of the insert part, the elongation resulting in the force fit, wherein an at least elastic deformation is present on the insert part prior to the attachment and is at least partially cancelled after the attachment.

2. The camshaft adjuster as recited in claim 1 wherein the insert part includes a deformation area including at least two members between the attachment areas, each of the at least two members connecting the attachment areas to one another, and sections of the insert part being coordinated with one another in such a way that an at least elastic deformation of the at least two members toward one another or away from one another brings about the elongation.

3. The camshaft adjuster as recited in claim 1 wherein the attachment areas project from a direction of the elongation.

4. The camshaft adjuster as recited in claim 1 wherein the at least one locking bolt includes two locking bolts provided to limit a rotational movement of the rotor in relation to the stator when the locking bolts each make contact with one gate of the insert part.

5. The camshaft adjuster as recited in claim 1 the at least one locking bolt is arranged to limit the rotor in relation to the stator at least in the one rotating direction in a central locking position.

6. A vane-cell hydraulic camshaft adjuster comprising:

a stator and a rotor, the rotor being mounted rotatably relative to the stator; and at least one locking bolt provided to limit the rotor in relation to the stator at least in one rotating direction when the locking bolt makes contact with a gate of an insert part, the insert part being attached in a component fixed to the stator, the insert part including attachment areas via which a force fit with the component fixed to the stator prevails, the insert part being designed in such a way in terms of material and geometry that a deformation brings about an elongation of the insert part, the elongation resulting in the force fit, the camshaft adjuster further comprising a deformation part separate from the insert part and introduced in the insert part, the deformation part when introduced effectuating the deformation of the insert part.

7. The camshaft adjuster of claim 6 wherein the deformation part is a pin, a screw or a cone.

8. The camshaft adjuster of claim 7 wherein the deformation part is composed of a solid material or a hollow material.

9. The camshaft adjuster as recited in claim 6 wherein the deformation part has a lobed or eccentric outer contour so that the deformation part is introduced with play, the deformation being caused by a rotation of the deformation part.

* * * * *